US011181846B2

(12) United States Patent
Kinumatsu et al.

(10) Patent No.: US 11,181,846 B2
(45) Date of Patent: Nov. 23, 2021

(54) TONER

(71) Applicant: CANON KABUSHIKI KAISHA, Tokyo (JP)

(72) Inventors: Tetsuya Kinumatsu, Mishima (JP); Tomohiro Unno, Numazu (JP); Mariko Yamashita, Suntou-gun (JP); Ryo Nagata, Tokyo (JP); Kosuke Fukudome, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/908,885

(22) Filed: Jun. 23, 2020

(65) Prior Publication Data

US 2020/0409283 A1 Dec. 31, 2020

(30) Foreign Application Priority Data

Jun. 27, 2019 (JP) ..... JP2019-120148

(51) Int. Cl.

| | |
|---|---|
| ***G03G 9/087*** | (2006.01) |
| ***G03G 9/097*** | (2006.01) |
| ***G03G 9/083*** | (2006.01) |
| ***G03G 9/08*** | (2006.01) |

(52) U.S. Cl.

CPC ..... *G03G 9/09733* (2013.01); *G03G 9/083* (2013.01); *G03G 9/0819* (2013.01); *G03G 9/08711* (2013.01); *G03G 9/08755* (2013.01)

(58) Field of Classification Search

CPC ..... G03G 9/0825; G03G 9/08782

See application file for complete search history.

(56) References Cited

U.S. PATENT DOCUMENTS

| | | | |
|---|---|---|---|
| 8,603,712 | B2 | 12/2013 | Aoki et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 9,034,549 | B2 | 5/2015 | Shiotari et al. |

(Continued)

FOREIGN PATENT DOCUMENTS

| | | |
|---|---|---|
| JP | 2015-045858 | 3/2015 |
| JP | 2017-211648 | 11/2017 |

(Continued)

OTHER PUBLICATIONS

U.S. Appl. No. 16/864,273, Mariko Yamashita, filed May 1, 2020.
U.S. Appl. No. 16/864,341, Ryo Nagata, filed May 1, 2020.
U.S. Appl. No. 16/08,857, Tomohiro Unno, filed Jun. 23, 2020.

*Primary Examiner* — Peter L Vajda
(74) *Attorney, Agent, or Firm* — Venable LLP

(57) ABSTRACT

A toner including a toner particle including a binder resin and a crystalline material, wherein in powder dynamic viscoelasticity measurement of the toner, where an onset temperature of a storage elastic modulus E' obtained when a temperature is raised at 20° C./min is denoted by T(A)° C., and an onset temperature of a storage elastic modulus E' obtained when a temperature is raised at 5° C./min is denoted by T(B)° C., T(A)−T(B) is 3.0° C. or less, in DSC of the toner, a peak temperature of a maximum endothermic peak is from 50.0° C. to 90.0° C., and an amount of a tetrahydrofuran-insoluble component in the binder resin is from 15% by mass to 60% by mass.

9 Claims, 1 Drawing Sheet

(56) References Cited

U.S. PATENT DOCUMENTS

| | | | |
|---|---|---|---|
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,170,509 | B2 | 10/2015 | Masuda |
| 9,201,323 | B2 | 12/2015 | Nishikawa et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,857,713 | B2 | 1/2018 | Kosaki et al. |
| 9,869,943 | B2 | 1/2018 | Aoki et al. |
| 9,964,881 | B2 | 5/2018 | Ikejiri et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 10,578,990 | B2 | 3/2020 | Tsuda et al. |
| 10,747,136 | B2 | 8/2020 | Kenmoku et al. |
| 10,782,623 | B2 | 9/2020 | Yoshiba et al. |
| 2019/0137900 | A1* | 5/2019 | Nakagawa ..... G03G 9/08797 |
| 2020/0103774 | A1 | 4/2020 | Fukudome et al. |
| 2020/0103776 | A1 | 4/2020 | Kinumatsu et al. |
| 2020/0166861 | A1 | 5/2020 | Uratani et al. |
| 2020/0183293 | A1 | 6/2020 | Kinumatsu et al. |
| 2020/0183294 | A1 | 6/2020 | Fukudome et al. |
| 2020/0183296 | A1 | 6/2020 | Nishikawa et al. |

FOREIGN PATENT DOCUMENTS

| | | |
|---|---|---|
| JP | 2018-173499 | 11/2018 |
| WO | 2013/047296 | 4/2013 |

* cited by examiner

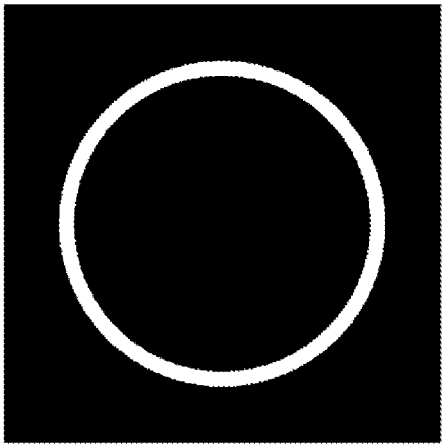

TONER

BACKGROUND OF THE INVENTION

Field of the Invention

The present invention relates to a toner for use in a recording method using an electrophotographic method, an electrostatic recording method, or a toner jet recording method.

Description of the Related Art

Electrophotographic image forming apparatuses are required to have higher performance such as higher image quality and lower energy consumption, and diversification of functions such as a capability of printing on various types of paper. In order to meet these requirements, the toner performance also needs to be further improved.

First, from the viewpoint of energy saving, it is required that the toner be fixed at a much lower temperature. Further, when outputting on paper of various sizes, a toner that is resistant to hot offset on the edges is required. This is because when large-size paper is passed after small-size paper has been continuously passed through a fixing device, the temperature of the non-paper-passing portion of the fixing device rises due to the continuous passing of the small size paper, which facilitates the generation of hot offset on the edges and causes image quality deterioration.

There are various issues regarding high image quality, and various performance improvements of toner are required. Among them, improvement of image unevenness is an important issue regardless of the model. Image unevenness can be generally classified into density unevenness and gloss unevenness. One of the causes of gloss unevenness is that at the time of fixing, the toner shape differs between a protrusion and a recess on the paper and the light reflection differs due to the difference in the amount of deformation of the toner due to the unevenness of the paper.

In other words, in order to solve the problem of gloss unevenness, it is necessary to reduce the difference in the amount of deformation of the toner between a recess and a protrusion at the time of fixing while improving the low-temperature fixability.

WO 2013/047296 proposes a toner having the low-temperature fixability improved by adding an ester compound having a specific structure to the toner. Japanese Patent Application Publication No. 2018-173499 discloses the feature of improving the low-temperature fixability of a toner by controlling a storage elastic modulus at a plurality of temperatures within a specific numerical range.

Meanwhile, Japanese Patent Application Publication No. 2015-045858 proposes a toner in which a hot offset at the edges is improved by using a binder resin having a cross-linked structure. Further, Japanese Patent Application Publication No. 2017-211648 proposes a toner in which an onset temperature of a storage elastic modulus of a toner and the value of the storage elastic modulus at the onset temperature are controlled to be within predetermined numerical ranges.

SUMMARY OF THE INVENTION

However, a problem associated with the toner described in WO 2013/047296 is that gloss unevenness occurs because the viscosity after heating is low, hot offset tends to occur, and the difference in the amount of deformation of the toner between a recess and a protrusion is large.

Further, each of the toners described in Japanese Patent Application Publication No. 2018-173499, Japanese Patent Application Publication No. 2015-045858 and Japanese Patent Application Publication No. 2017-211648 has room for further improvement in gloss unevenness suppression.

For these reasons, it has been very difficult to realize a toner that is excellent in low-temperature fixability and that makes it possible to suppress simultaneously gloss unevenness and hot offset on the edges.

The present invention provides a toner that is excellent in low-temperature fixability and makes it possible to suppress simultaneously gloss unevenness and hot offset on the edges.

The present inventors have found that the above-mentioned problems can be solved by controlling the heating rate dependence of the melting start temperature of the toner, the peak temperature of the maximum endothermic peak of the toner, and the amount of the tetrahydrofuran-insoluble component in the binder resin. This finding led to the completion of the present invention.

That is, the toner of the present invention is a toner including a toner particle including a binder resin and a crystalline material, wherein in powder dynamic viscoelasticity measurement of the toner, where an onset temperature of a storage elastic modulus E' obtained when a temperature is raised at 20° C./min is denoted by T(A)° C., and an onset temperature of a storage elastic modulus E' obtained when a temperature is raised at 5° C./min is denoted by T(B)° C., a following formula (1) is satisfied:

$$T(A)-T(B)\leq 3.0^\circ\ \mathrm{C.} \quad (1);$$

in differential scanning calorimetry of the toner, a peak temperature of a maximum endothermic peak is from 50.0° C. to 90.0° C.; and an amount of a tetrahydrofuran-insoluble component in the binder resin is from 15% by mass to 60% by mass.

According to the present invention, a toner that is excellent in low-temperature fixability and makes it possible to suppress simultaneously gloss unevenness and hot offset on the edges can be obtained.

Further features of the present invention will become apparent from the following description of exemplary embodiments with reference to the attached drawings.

BRIEF DESCRIPTION OF THE DRAWINGS

The FIGURE is an image of a mask used for image processing.

DESCRIPTION OF THE EMBODIMENTS

In the present invention, the description of "from XX to YY" or "XX to YY" representing a numerical range means a numerical range including a lower limit and an upper limit which are endpoints unless otherwise specified.

The term "monomer unit" refers to a reacted form of a monomer substance in a polymer. For example, one section of a carbon-carbon bond in a main chain obtained by polymerizing a vinyl-based monomer in a polymer is defined as one unit.

Hereinafter, the present invention will be described in more detail with reference to embodiments, but the present invention is not limited thereto.

The toner of the present invention is a toner including a toner particle including a binder resin and a crystalline material, wherein in powder dynamic viscoelasticity measurement of the toner, where an onset temperature of a storage elastic modulus E' obtained when a temperature is raised at 20° C./min is denoted by T(A)° C., and an onset temperature of a storage elastic modulus E' obtained when a temperature is raised at 5° C./min is denoted by T(B)° C., a following formula (1) is satisfied:

$$T(A)-T(B)\leq 3.0^\circ\ \text{C.} \quad (1);$$

in differential scanning calorimetry of the toner, a peak temperature of a maximum endothermic peak is from 50.0° C. to 90.0° C.; and an amount of a tetrahydrofuran-insoluble component in the binder resin is from 15% by mass to 60% by mass.

By controlling the amount of a tetrahydrofuran (hereinafter also referred to as THF) insoluble component in the binder resin, hot offset and gloss unevenness can be suppressed. Here, by making the heating rate dependency of the melting start temperature of the toner equal to or less than a certain value, it is possible to suppress gloss unevenness that depends on the unevenness of the paper at the time of high-speed output and that was conventionally difficult to suppress. In addition, it is possible to improve the low-temperature fixability while suppressing the influence of the amount of the THF-insoluble component on the low-temperature fixability, and to achieve unprecedented high-level balance of low-temperature fixability, suppression of gloss unevenness, and suppression of hot offset on the edges.

It can be assumed that gloss unevenness occurs due to the difference in the amount of deformation of the toner between a recess and a protrusion of the paper, and occurs because of the difference in how heat is applied to the toner between the recess and the protrusion of the paper. That is, it is considered that the amount of heat applied to the toner in the recess is smaller than that in the protrusion, and therefore, gloss unevenness is more prominent at a high-speed output.

The present inventors have focused on crystalline materials in order to solve the above problems. By using a crystalline material having a high affinity for the binder resin, the binder resin can be plasticized.

However, a crystalline material having a high affinity for the binder resin may plasticize the binder resin not at the time of fixing as well. For this reason, the storability tends to decrease, and the binder resin is fluidized at the time of fixing, whereby the resistance to hot offset on the edges tends to decrease. Further, since the melted toner easily forms a smooth surface at the protrusion of the paper, the toner melted in the recess and the toner melted at the protrusion are likely to have different shapes, resulting in even greater gloss unevenness.

The present inventors have found that the low-temperature fixability, suppression of gloss unevenness, and suppression of hot offset on the edges can be simultaneously achieved by using a crystalline material for a toner particle and controlling the peak temperature of the maximum endothermic peak of the toner and the amount of a THF-insoluble component in the binder resin while suppressing the heating rate dependence of the melting start temperature of the toner, and this finding led to the completion of the present invention.

The toner is such that in powder dynamic viscoelasticity measurement of the toner, where an onset temperature of a storage elastic modulus E' obtained when a temperature is raised at 20° C./min is denoted by T(A)° C., and an onset temperature of a storage elastic modulus E' obtained when a temperature is raised at 5° C./min is denoted by T(B)° C., a following formula (1) is satisfied:

$$T(A)-T(B)\leq 3.0^\circ\ \text{C.} \quad (1);$$

T(A)−T(B) is preferably 2.0° C. or less, more preferably 1.5° C. or less. The lower limit of T(A)−T(B) is not particularly limited, and the smaller the better, for example, 0.0° C. or more. The numerical ranges can be arbitrarily combined.

Where T(A)−T(B) exceeds 3.0° C., the heating rate dependence of the melting temperature of the toner becomes large, the toner is insufficiently heated in the recess of the paper at the time of high-speed output of an image, the gloss unevenness is further increased, and image quality is degraded. T(A)−T(B) can be controlled by adjusting the affinity between the crystalline material and the binder resin, the amount of the crystalline material, the type and amount of the polymerizable monomer capable of forming the binder resin, and the type and amount of the crosslinking agent.

By setting the ramp rate in the powder dynamic viscoelasticity measurement of the toner to 20° C./min, it is possible to ascertain a rapid change in the melting of the toner during fixing. By setting the ramp rate to 5° C./min, a change in melting when the toner is sufficiently heated under mild conditions can be ascertained.

From the viewpoints of storage stability and low-temperature fixability, T(A) is preferably from 40.0° C. to 70.0° C., and more preferably from 45.0° C. to 65.0° C. T(A) can be controlled by using a crystalline material having a low melting point, using a crystalline material having high compatibility with the binder resin, and controlling the structure of the binder resin.

Further, T(B) is preferably from 37.0° C. to 67.0° C., and more preferably from 42.0° C. to 62.0° C. T(B) can be controlled by changing the affinity between the crystalline material and the binder resin, the amount of the crystalline material, the type and amount of the polymerizable monomer capable of forming the binder resin, and the like.

In the differential scanning calorimetry of the toner, the peak temperature of the maximum endothermic peak is from 50.0° C. to 90.0° C., and this peak temperature is preferably from 55.0° C. to 85.0° C., and more preferably from 60.0° C. to 80.0° C.

When the peak temperature is less than 50.0° C., problems such as low density and streaks occur at the time of image output, and image quality degrades due to aggregation of the toner during storage or transportation, or outmigration of the components located inside the toner. When the peak temperature exceeds 90.0° C., since the fluidization of the crystalline material does not occur unless the temperature exceeds 90.0° C., the low-temperature fixability decreases, further gloss unevenness occurs, and image quality degrades.

The peak temperature can be controlled by changing the amount and type of the crystalline material.

The amount of the tetrahydrofuran-insoluble component in the binder resin is from 15% by mass to 60% by mass. The amount of the THF-insoluble component is preferably from 20% by mass to 55% by mass, and more preferably from 25% by mass to 50% by mass.

When the amount of the THF-insoluble component is less than 15% by mass, the binder resin tends to fluidize at the time of fixing. As a result, the hot offset resistance on the edges decreases. In addition, the toner melted at the protrusions of the paper such as described above may be smoothed to further cause uneven gloss.

When the amount of the THF-insoluble component exceeds 60% by mass, the binder resin becomes rigid and hardly deforms at the time of fixing. As a result, the low-temperature fixability is likely to be reduced, and the toner in the recesses of the paper is less likely to be melted and deformed than the toner in the protrusions to further cause uneven gloss.

The amount of the THF-insoluble component can be controlled by changing the number of parts and type of the crosslinking agent in the binder resin and the type and amount of the polymerizable monomer capable of forming the binder resin.

In the cross section of the toner observed with a transmission electron microscope, the average of the number of domains of the crystalline material having a major axis from 20 nm to 300 nm (hereinafter, simply referred to as an average number) is preferably from 50 to 500. The average number is more preferably from 100 to 400.

When the average number is 50 or more, the interface between the crystalline material and the binder resin can be increased, the binder resin is easily plasticized at the time of fixing and the low-temperature fixability is improved or the gloss unevenness is suppressed. Further, when the average number is 500 or less, the possibility that the binder resin is plasticized other than at the time of fixing can be reduced, and the storage stability can be improved.

The average number can be controlled by changing the type, amount and combination of the crystalline material, or by changing the cooling rate and the cooling start temperature at which the crystalline material is crystallized from a state in which the crystalline material is compatible with the binder resin during toner particle production.

In the cross section of the toner observed with a transmission electron microscope, the average major axis length of the domains of the crystalline material (hereinafter, also referred to as average length) is preferably 20 nm or more, more preferably 30 nm or more, and even more preferably 50 nm or more. The average length is preferably 300 nm or less, more preferably 250 nm or less, and even more preferably 200 nm or less. These numerical ranges can be arbitrarily combined to obtain, for example, from 50 nm to 300 nm.

When the average length is 20 nm or more, the crystalline material in the toner particles can maintain a crystalline state, and the low-temperature fixability is improved. Further, when the average length is 300 nm or less, the interface between the crystalline material and the binder resin can be increased, the binder resin is easily plasticized at the time of fixing, the low-temperature fixability is improved, and the gloss unevenness is suppressed.

The average length can be controlled by changing the type and amount of the crystalline material and the cooling rate and the cooling start temperature at which the crystalline material is crystallized from a state in which the crystalline material is compatible with the binder resin during toner particle production.

In the cross section of the toner observed with a transmission electron microscope, where the number of toner particles having domains of the crystalline material that have a major axis of 500 nm or more is denoted by C, and the number of toner particles that do not have the domains of the crystalline material having a major axis of 500 nm or more is denoted by D, a following formula (2) is satisfied:

$$C/(C+D) \leq 0.20 \quad (2).$$

Preferably C/(C+D) is 0.15 or less, and more preferably 0.10 or less. Further, preferably, C/(C+D) is 0.00 or more. By setting C/(C+D) to 0.20 or less, the number of domains of the crystalline material having a small interface with the binder resin is reduced, efficient fixing becomes possible, and superior low-temperature fixability and gloss unevenness suppression are achieved.

C/(C+D) can be controlled by changing the type, amount, and combination of the crystalline material, and changing the cooling rate and the cooling start temperature when the crystalline material is crystallized from a state in which the crystalline material is compatible with the binder resin during toner particle production.

The toner particle includes a binder resin. The amount of the binder resin in the toner particle is preferably from 40% by mass to 80% by mass.

The binder resin is not particularly limited, and a known resin for toners can be used. Specific examples of the binder resin include a polyester resin, a polyurethane resin, and a vinyl resin such as a styrene acrylic resin, but are not limited thereto. The amount of the styrene acrylic resin in the binder resin is preferably from 50% by mass to 97% by mass.

Examples of monomers usable for the production of vinyl resin are listed hereinbelow.

Aliphatic vinyl hydrocarbons:

alkenes, for example, ethylene, propylene, butene, isobutylene, pentene, heptene, diisobutylene, octene, dodecene, octadecene, and other α-olefins; alkadienes, for example, butadiene, isoprene, 1, 4-pentadiene, 1,6-hexadiene, and 1,7-octadiene.

Alicyclic vinyl hydrocarbons: mono- or di-cycloalkenes and alkadienes, for example, cyclohexene, cyclopentadiene, vinylcyclohexene, ethylidene bicycloheptene;

terpenes, for example, pinene, limonene, and indene.

Aromatic vinyl hydrocarbons:

styrene and hydrocarbyl (alkyl, cycloalkyl, aralkyl and/or alkenyl) substituents thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxy group-including vinyl monomers and metal salts thereof:

unsaturated monocarboxylic acids having from 3 to 30 carbon atoms, unsaturated dicarboxylic acids, anhydrides thereof and monoalkyl (from 1 to 27 carbon atoms) esters thereof.

For example, acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoethers of itaconic acid, citraconic acid, monoalkyl esters of citraconic acid, and carboxy group-including vinyl monomers of cinnamic acid.

Vinyl esters, for example, vinyl acetate, vinyl butyrate, vinyl propionate, vinyl butyrate, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl α-ethoxy acrylate, alkyl acrylates and alkyl methacrylates having an alkyl group (linear or branched) having from 1 to 22 carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (dialkyl esters of fumaric acid, the two alkyl groups are a linear, branched or alicyclic group having from 2 to 8 carbon atoms), dialkyl maleates (dialkyl esters of maleic acid, the two alkyl groups are a linear, branched or alicyclic group having from 2 to 8 carbon atoms), polyallyloxyalkanes (diallyloxyethane, triallyloxyethane, tetraallyloxyethane, tetraallyloxypropane, tetraallyloxybutane, and tetramethallyloxyethane), vinyl monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter also referred to EO) 10 mol adduct acrylate, methyl alcohol ethylene oxide 10 mol adduct methacrylate, lauryl alcohol EO 30 mol adduct acrylate, and lauryl alcohol EO 30 mol methacrylate), polyacrylates and polymethacrylates (polyacrylates and polymethacrylates of polyvalent alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-including vinyl esters:

for example, carboxyalkyl acrylates having an alkyl chain having from 3 to 20 carbon atoms, and carboxyalkyl methacrylates having an alkyl chain having from 3 to 20 carbon atoms.

Among them, styrene, butyl acrylate and the like are preferred.

The binder resin may include an amorphous polyester resin. Here, the amorphous resin is a resin for which a clear endothermic peak (melting point) is not observed in differential scanning calorimetry.

Examples of monomers usable for the production of the amorphous polyester resin include conventionally known divalent or trivalent or higher carboxylic acids and divalent or trivalent or higher alcohols. Specific examples of these monomers are listed hereinbelow.

Examples of the divalent or trivalent or higher carboxylic acid are listed hereinbelow.

Divalent carboxylic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid dodecenylsuccinic acid, and the like, and anhydrides thereof and lower alkyl esters thereof.

Aliphatic unsaturated dicarboxylic acids such as maleic acid, fumaric acid, itaconic acid, citraconic acid, and the like, and lower alkyl esters thereof and anhydrides thereof.

1,2,4-Benzenetricarboxylic acid, 1,2,5-benzenetricarboxylic acid, and anhydrides thereof and lower alkyl esters thereof.

These may be used alone or in combination of two or more.

Examples of the divalent or trivalent or higher alcohols are listed hereinbelow.

Alkylene diols (1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-icosanediol);

alkylene ether glycols (trimethylene glycol, tetramethylene glycol);

alicyclic diols (1,4-cyclohexanedimethanol);

bisphenols (bisphenol A); and alkylene oxide (ethylene oxide and propylene oxide) adducts of alicyclic diols, and alkylene oxides (ethylene oxide and propylene oxide) adducts of bisphenols (bisphenol A).

The alkyl segment of the alkylene diol and the alkylene ether glycol may be linear or branched. Alkylene diols having a branched structure can also be preferably used.

Further, aliphatic diols having a double bond can be used. Examples of the aliphatic diols having a double bond include the following compounds.

2-Butene-1,4-diol, 3-hexene-1,6-diol, and 4-octene-1,8-diol.

Further, examples of the trivalent or higher alcohols include glycerin, trimethylolethane, trimethylolpropane, pentaerythritol, and the like.

These may be used alone or in combination of two or more.

A monovalent acid such as acetic acid, benzoic acid, and the like and a monovalent alcohol such as cyclohexanol, benzyl alcohol, and the like can be used, as needed, for the purpose of adjusting the acid value and the hydroxyl value.

The amount of the amorphous polyester resin in the binder resin is preferably from 2% by mass to 8% by mass.

From the viewpoint of low-temperature fixability, the glass transition temperature (hereinafter, also referred to as Tg) of the binder resin measured using a differential scanning calorimeter (hereinafter, also referred to as DSC) is preferably from 40.0° C. to 100.0° C.

The toner particle includes a crystalline material.

From the viewpoint of fixability, the crystalline material may include a crystalline polyester resin.

The crystalline polyester resin is, for example, a condensation polymer of an aliphatic diol and an aliphatic dicarboxylic acid.

Among them, a condensation polymer of an aliphatic diol having from 2 to 12 carbon atoms and an aliphatic dicarboxylic acid having from 2 to 12 carbon atoms is preferable.

Examples of the aliphatic diol having from 2 to 12 carbon atoms include the following compounds.

1,2-Ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, and the like. These may be used alone or as a mixture of two or more.

Examples of the aliphatic dicarboxylic acid having from 2 to 12 carbon atoms include the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, and lower alkyl esters and acid anhydrides of these aliphatic dicarboxylic acids.

Among these, sebacic acid, adipic acid and 1,10-decanedicarboxylic acid, and lower alkyl esters and acid anhydrides thereof are preferred. These may be used alone or as a mixture of two or more.

An aromatic dicarboxylic acid can also be used. Examples of the aromatic dicarboxylic acid include the following compounds.

Terephthalic acid, isophthalic acid, 2,6-naphthalenedicarboxylic acid and 4,4'-biphenyldicarboxylic acid. Among these, terephthalic acid is preferred because it is easily available and easily forms a polymer having a low melting point.

A method for producing the crystalline polyester resin is not particularly limited, and the crystalline polyester resin can be produced by a general polyester polymerization method in which a dicarboxylic acid component and a diol component are reacted. Examples of the polymerization method include a direct polycondensation method and a transesterification method. A polyester polymerization method can be selected for use according on the type of monomers.

The amount or addition amount of the crystalline polyester resin is preferably from 1.0 part by mass to 30.0 parts by mass, and more preferably from 3.0 parts by mass to 25.0 parts by mass with respect to 100 parts by mass of the binder resin or the polymerizable monomer capable of forming the binder resin.

From the viewpoint of low-temperature fixability, the peak temperature of the maximum endothermic peak of the crystalline polyester resin measured by DSC is preferably from 50.0° C. to 100.0° C., and more preferably from 60.0° C. to 90.0° C.

From the viewpoint of fixing performance and releasability, the crystalline material may include wax.

The wax is not particularly limited, and can be exemplified by known waxes.

Specific examples include petroleum waxes such as paraffin wax, microcrystalline wax, petrolactam, and the like and derivatives thereof, montan wax and derivatives thereof, hydrocarbon waxes obtained by the Fischer-Tropsch method and derivatives thereof, polyolefin waxes represented by polyethylene and polypropylene and derivatives thereof, natural waxes such as carnauba wax and candelilla wax and derivatives thereof, ester waxes, and the like.

Here, the derivatives are inclusive of oxides, block copolymers with a vinyl-based monomer, and graft-modified products.

Further, monoester compounds including one ester bond in one molecule, diester compounds including two ester bonds in one molecule, and polyfunctional ester compounds including three or more ester bonds in one molecule can be used as the ester waxes. Among them, diester compounds are preferred.

Examples of the ester wax include dibehenyl sebacate, ethylene glycol dibehenate, ethylene glycol distearate, ethylene glycol arachidinate stearate, ethylene glycol stearate palmitate, butylene glycol dibehenate, butylene glycol distearate, butylene glycol arachidinate stearate, butylene glycol stearate palmitate, and butylene glycol dibehenate.

The molecular weight of the ester wax is preferably 800 or less, and more preferably 700 or less.

The wax preferably includes at least one compound selected from the group consisting of hydrocarbon waxes such as paraffin wax, monoester compounds and diester compounds. One type of the wax may be used alone, or two or more types may be used in combination.

The amount or addition amount of the wax is preferably from 1.0 part by mass to 40.0 parts by mass, and more preferably from 3.0 parts by mass to 35.0 parts by mass with respect to 100 parts by mass of the binder resin or the polymerizable monomer capable of forming the binder resin.

From the viewpoint of releasability and fixing performance, the peak temperature of the maximum endothermic peak of the wax measured by DSC is preferably from 50.0° C. to 100.0° C., and more preferably from 60.0° C. to 90.0° C. The melting point of the wax is the peak temperature of the maximum endothermic peak in the differential scanning calorimetry of the ester wax.

From the viewpoint of fixing performance, the crystalline material preferably includes an ester wax. Among ester waxes, diester waxes are more preferable. The binder resin can be suitably plasticized by including the ester wax.

When the crystalline material contains an ester wax, where an SP value of the ester wax is denoted by SP (W) $(J/cm^3)^{1/2}$ and an SP value of the binder resin is denoted by SP (B) $(J/cm^3)^{1/2}$, a relationship of a following formula (3) is satisfied.

$$2.00 \leq |SP(W)-SP(B)| \leq 4.50 \quad (3)$$

The SP value is also referred to as a solubility parameter, and is a numerical value used as an index of solubility or affinity indicating how much a certain substance dissolves in a certain substance. Those having close SP values have high solubility and high affinity, and those having far SP values have low solubility and low affinity.

The SP value can be calculated by solubility parameter calculation software, Hansen Solubility Parameters in Practice 4th Edition 4.1.03 (available from https://www.hansen-solubility.com/HSPiP/). The calculation method is based on Hansen's theory of solubility parameters. In the theory of Hansen's solubility parameter, the energy of evaporation of a molecule is divided into three energies: the energy from dispersion forces (dispersion term D), the energy from dipole interaction (polarization term P), and the energy from hydrogen bonds (hydrogen bond term H), and these can be treated as three-dimensional vectors.

|SP (W)−SP (B)| indicates the distance between the three-dimensional vector of the SP value of the ester wax and the three-dimensional vector of the SP value of the binder resin. The SP value is obtained by first calculating a dispersion term D, a polarization term P, and a hydrogen bond term H using solubility parameter calculation software, and then taking the square root of the sum of the squared values of the terms to obtain the scalar amount of the three-dimensional vector. The three-dimensional vector of the SP value is calculated by the following method.

Homopolymer, Random Copolymer (1): Hansen SP values (D, P, H), molar volume, and molecular weight for each unit (hereinafter also referred to as a monomer unit) derived from each monomer which is a precursor of a vinyl resin or a polyester are calculated using the solubility parameter calculation software.

Monomer used for vinyl resin: calculated for a state where an unknown halogen $X_2$ that does not affect the calculation result is attached to a double bond that is cleaved by polymerization as in the following formula (A).

(A)

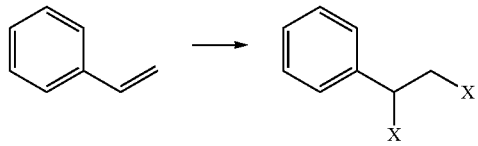

Monomer used for polyester: calculated for a state where one of the functional groups in the monomer that undergoes a condensation reaction is changed to [—C(═O)O—X] or [XC(═O)—O—], and one more functional group is substituted with X as in the following formula (B).

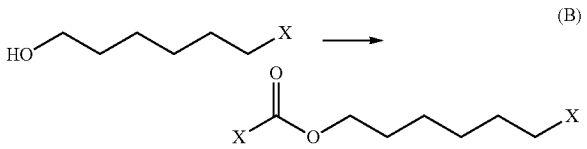

(2): From the molar ratio of each monomer unit in the polymer and the molar volume of each unit, the molar volume ratio of the unit derived from each monomer is calculated.

(3): The sum of the molar volume ratio multiplied by the value of D term of the Hansen SP value of each monomer unit is taken as the value of D term of the Hansen SP value of the polymer. The P term and the H term are similarly calculated.

(4): The square root of the sum of the squares of the D, P, and H terms calculated in (3) is found and taken as the SP value of the polymer ($(J/cm^3)^{1/2}$)

In the method of deriving the Hansen SP value when the binder resin or the like is a mixture of two or more substances, first, the Hansen SP values (D, P, and H terms) of each substance are derived. Then, the values obtained by calculating the arithmetic averages of the parameters between the D terms, between the P terms, and between the H terms of each substance are defined as Hansen SP values (D, P, and H terms) of the mixture.

Where |SP (W)−SP (B)| is from 2.00 $(J/cm^3)^{1/2}$ to 4.50 $(J/cm^3)^{1/2}$, the binder resin can be suitably plasticized, the low-temperature fixability can be improved, and a decrease in storage stability can be prevented. |SP (W)−SP (B)| is more preferably from 3.00 $(J/cm^3)^{1/2}$ to 4.00 $(J/cm^3)^{1/2}$

|SP (W)−SP (B)| can be controlled by changing the combination of the ester wax and the binder resin, the type and amount of the ester wax, and the composition of the binder resin.

The toner particle may include a colorant. Examples of the colorant include a pigment, a dye, and a magnetic body. These can be used alone or in combination of two or more.

Examples of black pigments include carbon blacks such as furnace black, channel black, acetylene black, thermal black, lamp black, and the like. These can be used alone or in combination of two or more.

A pigment or a dye can be used as a colorant suitable for the yellow color.

Examples of yellow pigments include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and C. I. Vat Yellow 1, 3, and 20. Examples of yellow dyes include C. I. Solvent Yellow 19, 44, 77, 79, 81, 82, 93, 98, 103, 104, 112, 162, and the like. These can be used alone or in combination of two or more.

A pigment or a dye can be used as a colorant suitable for the cyan color.

Examples of cyan pigments include C. I. Pigment Blue 1, 7, 15, 15:1, 15:2, 15:3, 15:4, 16, 17, 60, 62, 66, and the like, C. I. Vat Blue 6, and C. I. Acid Blue 45. Examples of cyan dyes include C. I. Solvent Blue 25, 36, 60, 70, 93, 95, and the like. These can be used alone or in combination of two or more.

A pigment or a dye can be used as a colorant suitable for the magenta color.

Examples of magenta pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, 254, and the like; C. I. Pigment Violet 19; C. I. Vat Red 1, 2, 10, 13, 15, 23, 29, and 35.

Examples of magenta dyes include oil-soluble dyes such as C. I. Solvent Red 1, 3, 8, 23, 24, 25, 27, 30, 49, 52, 58, 63, 81, 82, 83, 84, 100, 109, 111, 121, 122, and the like, C. I. Disperse Red 9, C. I. Solvent Violet 8, 13, 14, 21, 27, and the like, C. I. Disperse Violet 1, and the like; and basic dyes such as C. I. Basic Red 1, 2, 9, 12, 13, 14, 15, 17, 18, 22, 23, 24, 27, 29, 32, 34, 35, 36, 37, 38, 39, 40, and the like, C. I. Basic Violet 1, 3, 7, 10, 14, 15, 21, 25, 26, 27, 28, and the like. These can be used alone or in combination of two or more.

The amount or addition amount of the colorant (in the case other than the magnetic body) is from 1 part by mass to 20 parts by mass, and more preferably from 2 parts by mass to 15 parts by mass with respect to 100 parts by mass of the binder resin or the polymerizable monomer capable of forming the binder resin.

The toner particle preferably includes a magnetic body as a colorant. When a magnetic body is used as the colorant, a hard shell can be formed on the surface layer of the toner particle, and the durability of the toner can be improved.

Examples of the magnetic body include magnetic iron oxides such as magnetite, maghemite, ferrite, and the like; metals such as iron, cobalt, nickel, and the like, or alloys of these metals with a metal such as aluminum, copper, magnesium, tin, zinc, beryllium, calcium, manganese, selenium, titanium, tungsten, vanadium, and the like, and mixtures thereof.

The number average particle diameter of the primary particles of the magnetic body is preferably 0.50 μm or less, and more preferably from 0.05 μm to 0.30 μm.

The number average particle diameter of the primary particles of the magnetic body present in the toner particle can be measured using a transmission electron microscope.

Specifically, after sufficiently dispersing the toner particles to be observed in an epoxy resin, the epoxy resin is cured in an atmosphere at a temperature of 40° C. for 2 days to obtain a cured product. The resulting cured product is sliced with a microtome to obtain a flaky sample, an image with a magnification from 10,000 to 40,000 is captured taken with a transmission electron microscope (hereinafter also referred to as a TEM), and the projected area of 100 primary particles of the magnetic body in the image is measured. The equivalent diameter of a circle equal to the projected area is defined as the particle diameter of the primary particles of the magnetic body, and the average value of 100 particles is defined as the number average particle diameter of the primary particles of magnetic bodies.

The amount or addition amount of the magnetic body is preferably from 20 parts by mass to 100 parts by mass, and more preferably from 25 parts by mass to 90 parts by mass with respect to 100 parts by mass of the binder resin or the polymerizable monomer capable of forming the binder resin.

The amount of the magnetic body in the toner can be measured using a thermal analyzer TGA Q5000IR manufactured by PerkinElmer Inc. The measurement method involves heating the toner from room temperature to 900° C. at a ramp rate of 25° C./min under a nitrogen atmosphere, taking the mass loss from 100° C. to 750° C. as the mass of components after removing the magnetic body form the toner, and taking the remaining mass as the amount of the magnetic body.

The magnetic body can be manufactured, for example, by the following method.

An alkali such as sodium hydroxide or the like is added to the aqueous ferrous salt solution in an amount equivalent to or larger than that of the iron component to prepare an aqueous solution including ferrous hydroxide. Air is blown in while maintaining the pH of the prepared aqueous solution at 7 or more, and an oxidation reaction of ferrous hydroxide is performed while heating the aqueous solution to 70° C. or more, to first generate seed crystals serving as cores of magnetic iron oxide.

Next, an aqueous solution including about 1 equivalent of ferrous sulfate, based on the amount of the alkali added before, is added to the slurry liquid including the seed crystals. The reaction of ferrous hydroxide is advanced while maintaining the pH of the mixture at from 5 to 10 and blowing air, and magnetic iron oxide is grown around the seed crystals. At this time, the shape and magnetic properties of the magnetic body can be controlled by selecting arbitrary pH, reaction temperature, and stirring conditions. As the oxidation reaction proceeds, the pH of the mixed solution shifts to the acidic side, but the pH of the mixed solution is preferably maintained at 5 or more. The magnetic body can be obtained by filtering, washing and drying the magnetic body thus obtained by a conventional method.

The magnetic body may be subjected to a known surface treatment as necessary.

Examples of coupling agents that can be used in the surface treatment of the magnetic body include a silane coupling agent and a titanium coupling agent. It is more preferable to use a silane coupling agent, which is represented by a following formula (I).

$$R_m Si—Y_n \quad (I)$$

In the formula (I), R represents an alkoxy group (preferably having from 1 to 3 carbon atoms), m represents an integer from 1 to 3, Y represents a functional group such as an alkyl group (preferably having from 2 to 20 carbon atoms), a phenyl group, a vinyl group, an epoxy group, an acryl group, a methacryl group, and the like, and n represents an integer from 1 to 3. However, m+n=4.

Examples of the silane coupling agent represented by the formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane, and the like.

Among these, from the viewpoint of imparting high hydrophobicity to the magnetic body, it is preferable to use an alkyltrialkoxysilane coupling agent represented by the following formula (II).

$$C_pH_{2p+1}—Si—(OC_qH_{2q+1})_3 \quad (II)$$

In the formula (II), p represents an integer from 2 to 20, and q represents an integer from 1 to 3.

Where p in the above formula is 2 or more, sufficient hydrophobicity can be imparted to the magnetic body. Where p is 20 or less, hydrophobicity is sufficient, and coalescence between magnetic bodies can be suppressed. Further, where q is 3 or less, the reactivity of the silane coupling agent is satisfactory, and the magnetic body is likely to be sufficiently hydrophobized.

Therefore, it is preferable to use an alkyltrialkoxysilane coupling agent in which p represents an integer from 2 to 20 (more preferably an integer from 4 to 16) and q represents an integer from 1 to 3 (more preferably 1 or 2).

When using the above silane coupling agents, the treatment can be performed using a single agent or a plurality thereof in combination. When using a plurality of agents in combination, the treatment may be performed individually with each coupling agent or simultaneously.

The total treatment amount of the coupling agent used is preferably from 0.9 parts by mass to 3.0 parts by mass with respect to 100 parts by mass of the magnetic body, and it is preferable to adjust the amount of the treatment agent according to the surface area of the magnetic body, the reactivity of the coupling agent, and the like.

Where the toner particle includes a magnetic body, and an area ratio of the magnetic body in a cross section of the toner observed with a transmission electron microscope in a range from a contour of the cross section of the toner particle to 400 nm in the direction of a center of gravity of the cross section is defined as area ratio A1, the area ratio A1 is preferably from 35.0% to 80.0%. The area ratio A1 is more preferably from 40.0% to 75.0%, and even more preferably from 45.0% to 70.0%.

Where the area ratio A1 is within the above range, at least one of storage stability and low-temperature fixability is improved. The area ratio A1 can be controlled by changing the number of magnetic bodies or the medium used in the production of toner particles, or by selecting a toner raw material or a surface treatment agent such that the affinity between the magnetic body and the binder resin changes.

The toner particle may include a charge control agent. The toner is preferably a negatively chargeable toner.

Organometallic complex compounds, chelate compounds, and the like are preferable as the charge control agents for negative charge. Specific examples include monoazo metal complex compounds; acetylacetone metal complex compounds; metal complex compounds of an aromatic hydroxycarboxylic acid or an aromatic dicarboxylic acid; charge control resins described hereinbelow, and the like.

Specific examples of commercially available products include Spilon Black TRH, T-77, T-95 (Hodogaya Chemical Industry Co., Ltd.), and BONTRON (registered trademark) S-34, S-44, S-54, E-84, E-88 and E-89 (Orient Chemical Industry Co., Ltd.).

The charge control agents can be used alone or in combination of two or more.

From the viewpoint of charge quantity, the amount or addition amount of the charge control agent is preferably from 0.1 parts by mass to 10.0 parts by mass, and more preferably from 0.1 parts by mass to 5.0 parts by mass with respect to 100 parts by mass of the binder resin or the polymerizable monomer capable of forming the binder resin.

A polymer or copolymer having a sulfonic acid group, a sulfonic acid salt group or a sulfonic acid ester group is preferably used as the charge control resin. As the polymer having a sulfonic acid group, a sulfonic acid salt group or a sulfonic acid ester group, it is particularly preferable to include a sulfonic acid group-containing acrylamide monomer or a sulfonic acid group-containing methacrylamide monomer in a copolymerization ratio of 2% by mass or more. More preferably, the amount is 5% by mass or more in a copolymerization ratio.

The charge control resin preferably has a glass transition temperature (Tg) from 35° C. to 90° C., a peak molecular weight (hereinafter also referred to as Mp) from 10,000 to 30,000, and a weight average molecular weight (hereinafter also referred to as Mn) from 25,000 to 50,000. When a charge control resin that satisfies these properties is used, favorable triboelectric charging characteristics can be imparted while suppressing the influence on thermal characteristics required for the toner particle. Furthermore, since the charge control resin includes a sulfonic acid group, the dispersibility of the charge control resin itself in the colorant-dispersed solution and the dispersibility of the colorant are improved, and the tinting strength, transparency, and triboelectric charging characteristics can be further improved.

The toner may be also obtained by mixing toner particles with an external additive to attach the external particles to the toner particle surface in order to improve, if necessary, the flowability and/or the charging performance of the toner.

It is preferable to use a known device, for example, a Mitsui Henschel mixer (manufactured by Mitsui Miike Kakoki Co., Ltd.) for mixing the external additive.

Examples of the external additive include inorganic fine particles such as silica fine particles, titanium oxide fine particles, and alumina fine particles. As the silica fine particles, for example, both dry silica called fumed silica that is produced by vapor phase oxidation of a silicon halide and so-called wet silica manufactured from water glass can be used.

However, dry silica having fewer silanol groups on the surface and inside the silica fine particles and having less production residue such as $Na_2O$ and $SO_3^{2-}$ is more preferable.

In the case of dry silica, it is also possible to obtain composite fine particles of silica and another metal oxide, for example, by using a silicon halide together with another metal halide such as aluminum chloride and titanium chloride in the production process, and the dry silica is also inclusive of such composite fine particles.

The amount of the external additive is preferably from 0.1 parts by mass to 3.0 parts by mass with respect to 100 parts by mass of the toner particle.

When inorganic fine particles are used as an external additive, the amount of the inorganic fine particles can be quantified from a calibration curve prepared from a standard sample using a fluorescent X-ray analyzer.

The number average particle diameter of the primary particles of the inorganic fine particles is preferably from 4 nm to 80 nm, and more preferably from 6 nm to 40 nm.

When the inorganic fine particles are subjected to a hydrophobic treatment, the charging performance and environmental stability of the toner can be further improved. Examples of the treatment agent to be used in the hydrophobizing treatment include silicone varnish, various modified silicone varnishes, silicone oil, various modified silicone oils, silane compounds, silane coupling agents, other organosilicon compounds, organotitanium compounds, and the like. The treatment agents may be used alone or in combination of two or more.

The number average particle diameter of the primary particles of the inorganic fine particles can be calculated using a toner image enlarged and captured with a scanning electron microscope (SEM).

A method for producing the toner particles is not particularly limited, and any of a dry production method (for example, a kneading and pulverizing method and the like) and a wet production method (for example, an emulsion aggregation method, a suspension polymerization method, a solution suspension method, and the like) may be used. Among these, it is preferable to use the suspension polymerization method.

In the suspension polymerization method, for example, toner particles can be produced by the following method, but this method is not limiting.

A polymerizable monomer and a crystalline material capable of forming a binder resin, and if necessary, magnetic bodies, a polymerization initiator, a crosslinking agent, a charge control agent, and other additives are uniformly dispersed to obtain a polymerizable monomer composition. Thereafter, the obtained polymerizable monomer composition is dispersed and granulated in a continuous layer (for example, an aqueous phase) including a dispersion stabilizer using a suitable stirrer, and a polymerization reaction is conducted using a polymerization initiator to obtain toner particles having a desired particle diameter.

A polymerization initiator used in the production of toner particles by the suspension polymerization method preferably has a half-life of from 0.5 hours to 30 hours during the polymerization reaction is preferable. Further, the polymerization initiator is preferably used in an addition amount of from 0.5 part by mass to 20 parts by mass with respect to 100 parts by mass of the polymerizable monomer capable of forming the binder resin. In this case, a polymer having a maximum molecular weight between 5,000 and 50,000 can be obtained, and the toner particle can have preferable strength and appropriate melting characteristics.

Specific examples of polymerization initiators include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate, and the like. Among them, t-butyl peroxypivalate is preferred.

The aqueous medium in which the polymerizable monomer composition is to be dispersed may include a dispersion stabilizer.

As the dispersion stabilizer, known surfactants, organic dispersants and inorganic dispersants can be used. Among them, inorganic dispersants are preferred because they have dispersion stability owing to their steric hindrance, so that even if the reaction temperature is changed, the stability is hardly lost, the washing is easy, and the toner is hardly adversely affected thereby.

Examples of such inorganic dispersants include polyvalent metal phosphates such as tricalcium phosphate, magnesium phosphate, aluminum phosphate, zinc phosphate, hydroxyapatite, and the like; carbonates such as calcium carbonate, magnesium carbonate, and the like; inorganic salts such as calcium metasilicate, calcium sulfate, barium sulfate, and the like; and inorganic compounds such as calcium hydroxide, magnesium hydroxide, aluminum hydroxide, and the like.

These inorganic dispersants are preferably used in an amount of from 0.2 part by mass to 20.0 parts by mass with respect to 100.0 parts by mass of the polymerizable monomer. Further, the dispersion stabilizers may be used alone or in combination of two or more. Further, a surfactant may be used in combination in an amount of from 0.001 part by mass to 0.1 part by mass. When these inorganic dispersants are to be used, they may be used as they are, but in order to obtain finer particles, the inorganic dispersant particles can be generated and used in an aqueous medium.

For example, in the case of tricalcium phosphate, an aqueous solution of sodium phosphate and an aqueous solution of calcium chloride can be mixed under high-speed stirring to produce water-insoluble calcium phosphate, and more uniform and fine dispersion can be achieved. At this time, a water-soluble sodium chloride salt is by-produced at the same time, but it is preferable that a water-soluble salt be present in the aqueous medium, because the dissolution of the polymerizable monomer in water is prevented and an ultrafine toner is unlikely to be generated by emulsion polymerization.

Examples of the surfactant include sodium dodecylbenzene sulfate, sodium tetradecyl sulfate, sodium pentadecyl sulfate, sodium octyl sulfate, sodium oleate, sodium laurate, sodium stearate, potassium stearate, and the like.

In the step of polymerizing the polymerizable monomer, the polymerization temperature is usually set to 40° C. or higher, preferably from 50° C. to 90° C. When the polymerization is carried out in this temperature range, for example, the release agent and the like to be sealed inside is precipitated by phase separation, and the encapsulation becomes more complete.

Thereafter, a cooling step of cooling from a reaction temperature of about from 50° C. to 90° C. is performed to terminate the polymerization reaction step.

After completion of the polymerization of the polymerizable monomer, the obtained polymer particles are filtered, washed and dried by known methods to obtain toner particles. A toner can be obtained by mixing an external additive with the toner particles and attaching the external additive to the surface of the toner particles. It is also possible to introduce a classification step in the production process to cut coarse powder and fine powder included in the toner particles.

The toner particle may further include other additives within a range in which no substantial adverse effect is produced.

Examples of the other additives include lubricant powders such as fluororesin powder, zinc stearate powder, and polyvinylidene fluoride powder; abrasives such as cerium oxide powder, silicon carbide powder, strontium titanate powder and the like; anti-caking agents; and the like. The additive can be used after the surface thereof is subjected to a hydrophobic treatment.

The glass transition temperature (Tg) of the toner is preferably from 45.0° C. to 65.0° C., and more preferably from 50.0° C. to 65.0° C.

When the glass transition temperature is in the above range, both storage stability and low-temperature fixability can be achieved at a high level. The glass transition temperature can be controlled by the composition of the binder resin, the type of the crystalline polyester, the molecular weight of the binder resin, and the like.

The weight-average particle diameter (D4) of the toner is preferably from 3.00 μm to 9.00 μm, and more preferably from 5.00 μm to 8.00 μm.

By setting the weight-average particle diameter (D4) of the toner within the above range, it is possible to sufficiently satisfy the dot reproducibility while improving the handleability of the toner.

Further, the ratio (D4/D1) of the weight-average particle diameter (D4) to the number-average particle diameter (D1) of the toner is preferably less than 1.25.

Methods for measuring physical property values according to the present invention are described below.

Method for Measuring Weight-Average Particle Diameter (D4) and Number-Average Particle Diameter (D1) of Toner (Particle)

The weight-average particle diameter (D4) and the number-average particle diameter (D1) of the toner (particle) are calculated as follows.

A precision particle diameter distribution measuring apparatus "Coulter Counter Multisizer 3®" (manufactured by Beckman Coulter, Inc.) based on a pore electric resistance method and equipped with a 100-1 μm aperture tube is used as a measurement device. The dedicated software "Beckman Coulter Multisizer 3 Version 3.51" (manufactured by Beckman Coulter, Inc.) is used for setting measurement conditions and analyzing the measurement data. The measurement is performed with 25,000 effective measurement channels.

A solution prepared by dissolving special grade sodium chloride in ion exchanged water to a concentration of about 1% by mass, specifically, "ISOTON II" (manufactured by Beckman Coulter, Inc.), is used as the electrolytic aqueous solution to be used for the measurement.

The dedicated software is set up in the following manner before the measurement and analysis.

The total count number in a control mode is set to 50,000 particles on a "Changing Standard Operating Method (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "Threshold/Measure Noise Level". Further, the current is set to 1, 600 μA, the gain is set to 2, the electrolytic solution is set to ISOTON II, and "Flush Aperture Tube" of "After Each Run" is checked.

In the "Convert Pulses to Size Settings" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "Flush Aperture Tube" function of the dedicated software.

(2) Approximately 30 ml of the electrolytic aqueous solution is placed in a glass 100 mL flat-bottom beaker. Then, about 0.3 mL of a diluted solution obtained by about 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersant thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of about 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particle) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion process, the water temperature in the water tank is appropriately adjusted to a temperature from 10° C. to 40° C.

(6) The electrolytic aqueous solution of (5) hereinabove in which the toner (particle) is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the weight-average particle diameter (D4) and the number-average particle diameter (D1) are calculated. The "Average Diameter" on the "Analyze/Volume Statistics (Arithmetic Mean)" screen obtained when the graph/(% by volume) is set in the dedicated software is taken as the weight-average particle diameter (D4), and the "Average Diameter" on the "Analyze/Number Statistics (Arithmetic Mean)" screen obtained when the graph/(% by number) is set in the dedicated software is taken as the number-average particle diameter (D1).

Method for Measuring Peak Temperature (or Melting Point) of Maximum Endothermic Peak The peak temperature of the maximum endothermic peak of a toner or a crystalline material is measured under the following conditions by using a differential scanning calorimeter (DSC) Q2000 (manufactured by TA Instruments).

Ramp rate: 10° C./min

Measurement start temperature: 20° C.

Measurement end temperature: 180° C.

The melting points of indium and zinc are used for temperature correction of the apparatus detection unit, and the heat of melting of indium is used for correction of the calorific value.

Specifically, 5 mg of a sample is accurately weighed and placed in an aluminum pan, and measured once. An empty pan made of aluminum is used as a reference. The peak temperature of the maximum endothermic peak at that time is determined. As for, for example a wax, the peak temperature of the maximum endothermic peak is taken as the melting point.

Method for Measuring Glass Transition Temperature (Tg)

The glass transition temperature of a sample is determined using a reversing heat flow curve at the time of temperature increase obtained by differential scanning calorimetry of the peak temperature of the maximum endothermic peak, and is a temperature (° C.) at a point where a straight line equidistant in the vertical axis direction from a straight line obtained by extending the base line before and after a specific heat change and a curve of a stepwise change portion of glass transition in the reversing heat flow curve intersect each other.

Method for Measuring Weight-Average Molecular Weight (Mw) and Peak Molecular Weight (Mp) of Resin or the Like The weight-average molecular weight (Mw) and the peak molecular weight (Mp) of a resin and the like is measured in the following manner by gel permeation chromatography (GPC).

(1) Preparation of Measurement Sample

A sample and tetrahydrofuran (THF) are mixed at a concentration of 5.0 mg/mL, allowed to stand at room temperature for from 5 h to 6 h, and then shaken sufficiently, and the THF and the sample are mixed well until the sample no longer coalesces. The mixture is further allowed to stand at room temperature for 12 h or more. At this time, the time from the start of the mixing of the sample and THF to the end of the standing is set to be 72 h or more, and a tetrahydrofuran (THF) soluble matter of the sample is obtained.

Thereafter, the mixture is filtered through a solvent-resistant membrane filter (pore size: from 0.45 μm to 0.50 μm, Maishori Disk H-25-2 [manufactured by Tosoh Corporation]) to obtain a sample solution.

(2) Sample Measurement

Measurements were conducted under the following conditions by using the sample solution obtained.

Device: high-speed GPC device LC-GPC 150C (manufactured by Waters Corp.) Column: 7 sets of Shodex GPC KF-801, 802, 803, 804, 805, 806, and 807 (manufactured by Showa Denko K.K.)

Mobile phase: THF

Flow rate: 1.0 mL/min

Column temperature: 40° C.

Sample injection volume: 100 μL

Detector: RI (refractive index) detector

When measuring the molecular weight of a sample, the molecular weight distribution of the sample is calculated from the relationship between the logarithmic value of a calibration curve prepared from several types of monodisperse polystyrene standard samples and the count number.

Standard polystyrene samples used for preparing a calibration curve are manufactured by Pressure Chemical Co. or Toyo Soda Kogyo Co., Ltd. and have a molecular weight of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$.

Cross-Sectional Observation of Toner Cross-sectional observation of the toner with a transmission electron microscope (TEM) is performed by staining with ruthenium. A crystalline material included in the toner is less stained with ruthenium than an amorphous materials such as a binder resin, so that the contrast becomes clear and observation is facilitated. Since the amount of ruthenium atoms differs depending on the intensity of the staining, the weakly stained portion includes less amount of ruthenium atoms, hence easily transmits the electron beam and becomes white on the observed image. On the other hand, the strongly stained portion includes many of ruthenium atoms, the electron beam is hard to transmit, and becomes black on the observed image.

First, a toner is sprayed on a cover glass (Matsunami Glass Co., Ltd., angular cover glass, Square Shape No. 1) so as to form a monolayer, and an Os film (5 nm) and a naphthalene film (20 nm) are coated as protective films by using an Osmium Plasma Coater (filgen, Inc., OPC80T). Next, a PTFE tube (inner diameter ϕ1.5 mm×outer diameter ϕ3 mm×3 mm) is filled with a photocurable resin D800 (JEOL, Ltd.), and the cover glass is placed quietly on the tube in the orientation such that the toner contacts the photocurable resin D800. After curing the resin by irradiation with light in this state, the cover glass and the tube are removed to form a columnar resin in which the toner is embedded on the surface portion. The columnar resin is cut at a distance equal to the radius of the toner (4.0 μm when the weight-average particle diameter (D4) is 8.0 μm) from the outermost surface at a cutting speed of 0.6 mm/s by using an ULTRASONIC ULTRAMICROTOME (Leica Microsystems Inc., UC7) to open the cross section of the toner. Next, cutting is performed to obtain a film thickness of 250 nm and prepare a slice sample having the toner cross section. By cutting in such a manner, a cross section of the toner central portion is obtained.

The obtained slice sample is stained in a $RuO_4$ gas at a 500 Pa atmosphere for 15 min using a vacuum electron dyeing apparatus (filgen, Inc., VSC4R1H), and STEM observation is performed using a TEM (JEOL, Ltd., JEM2800).

An image with a STEM probe size of 1 nm and an image size of 1,024 pixels×1,024 pixels is acquired. Also, the Contrast of the Detector Control panel of the image field of view is adjusted to 1425, the Brightness to 3750, the Contrast of the Image Control panel to 0.0, the Brightness to 0.5, and the Gamma to 1.00, thereby obtaining TEM image.

Method for Measuring Area Ratio A1

A method for measuring area ration A1 is as follows.

First, a cross sectional image of the toner is obtained by the aforementioned method using transmission electron microscope (TEM).

Next, the obtained TEM image is binarized using image processing software "ImageJ" (available from https://imagej.Nih.gov/ij/). Toner cross section used for the measurement is defined as follows; a circle equivalent diameter (projected area circle equivalent diameter) is obtained from the binarized image of the cross section, and a cross section for which the value of the circle equivalent diameter is in a range of ±5% of the number-average particle diameter (D1) (μm) of the toner is selected.

From the TEM image of the corresponding particles, regions other than those necessary for the measurement are masked using "ImageJ", and the area of the unmasked region inside the toner outline and the total area of the magnetic bodies present in the unmasked region are calculated. A method for obtaining the area ratio A1 using this method will be specifically described hereinbelow.

First, the obtained TEM image of the outline of the toner cross section (hereinafter, referred to as image 1) is binarized so that the outline and the inside of the toner are white and the other background portions are black (hereinafter, referred to as image 2).

Next, in order to calculate the magnification of the mask, the length per unit pixel number in the image 1 is calculated. Next, from the calculated value, it is calculated how many pixels fit in the range from a contour of the cross section of the toner particle to 400 nm in the direction of a center of gravity of the cross section (hereinafter referred to as x1). Similarly, how many pixels fit in the toner particle diameter measured by using the above-described method is calculated (hereinafter referred to as x2). Then, the magnification M of the mask is calculated from:

$$M=(x2-x1)/x2.$$

Next, the image 2 is reduced to the calculated magnification M (the reduced image is referred to as an image 3). In the image 3, the image is configured such that the outline and the inside of the toner particle are black, and the other background portions are transparent.

Next, the image 2 and the image 3 are added. At this time, the image 2 and the image 3 are added using "Image Calculator" which is a function of "ImageJ", and an image 4, which is shown as the FIGURE, is created in which the region from a contour of the cross section of the toner particle to 400 nm in the direction of a center of gravity of the cross section is white, and the other parts are black. The area S1 of the white region in the image 4 is measured.

Next, the created image 4 and the aforementioned TEM image (image 1) are similarly added using "Image Calculator" to create an image 5 in which the region other than the range of 400 nm from the contour of the cross section of the toner particle toward the center of gravity of the toner particle cross section is masked. The image 5 is binarized, and an area S2 occupied by the magnetic body in the range is measured.

Finally, the area ratio al is calculated as S2/S1.

The above operation is performed on 100 particles of toner, and the arithmetic average value of the obtained 100 area ratios al is defined as the area ratio A1.

Method for Calculating an Average Number of Domains of the Crystalline Material Having a Major Axis from 20 nm to 300 nm, C/(C+D) and an Average Length the Domains of the Crystalline Material Observation is performed by the above-described method for observing the cross section of the toner, 50 toners with a diameter within ±2.0 μm from weight-average particle diameter of the toner are selected and images thereof are captured to obtain cross-sectional images.

As compared with an amorphous resin or a magnetic body, the crystalline material is less stained with Ru, and looks white to gray in the cross-sectional image.

As for the number of domains of the crystalline material, 50 particles of toner are randomly selected, the number of domains having a major axis from 20 nm to 300 nm is counted, and the average value among the 50 particles of toner is taken as the average number of domains having a major axis from 20 nm to 300 nm.

Further, 50 particles of toner are randomly selected, the number of toner particles having a domain having a major axis of 500 nm or more is denoted by C, the number of toner particles not having a domain having a major axis of 500 nm or more is denoted by D, and the value of C/(C+D) is determined.

Further, the average length of the domains of the crystalline material is determined by randomly selecting ten particles of toner, then further randomly selecting 100 domains of the crystalline material from among the domains of the crystalline material included in the selected ten particles of toner, measuring the major axis, and taking the average value thereof as the average length of the domains of the crystalline material in the toner cross section.

Method for Measuring the Content of Tetrahydrofuran (THF)-Insoluble Component 1.5 g of the toner is exactly weighed and is introduced into an extraction thimble (product name: No. 86R, size 28×100 mm, Advantec Toyo Kaisha, Ltd.) that has previously been exactly weighed, and this is set into a Soxhlet extractor.

Extraction is carried out for 20 hours using 200 mL of tetrahydrofuran (THF) as solvent, during which time the extraction is run at a reflux rate that provides an extraction solvent cycle of once in approximately 5 minutes.

After the completion of the extraction, the thimble is removed and is air dried, followed by vacuum drying for 8 hours at 40° C.; the mass of the thimble containing the extraction residue is weighed and the mass of the thimble is subtracted to determine the mass of the extraction residue W1 (g).

The content W2 (g) of the components other than the resin component is determined using the following procedure.

1.5 g of the toner is exactly weighed into a pre-weighed 30-mL porcelain crucible.

The porcelain crucible is placed in an electric furnace and is heated for about three hours at approximately 900° C. and is then left to cool in the electric furnace and is left to cool for at least one hour in a desiccator at normal temperature. The mass of the crucible containing the ignition residue is weighed, and the ignition residue is calculated by subtracting the mass of the crucible and this is used as W2 (g).

The content of the THF-insoluble component in the binder resin is determined using these values and the following formula.

$$\text{content (mass \%) of THF-insoluble component in the binder resin} = (W1 - W2)/(1.5 - W2) \times 100$$

Method for Measuring the Powder Dynamic Viscoelasticity of the Toner

The measurement is carried out using a DMA 8000 (PerkinElmer Inc.) dynamic viscoelastic measurement instrument.

measurement tool: Material Pocket (P/N: N533-0322)

80 mg of the toner is sandwiched in the Material Pocket; this is installed in the single cantilever; and attachment is carried out by tightening the screw with a torque wrench.

The "DMA Control Software" (PerkinElmer Inc.) dedicated software is used for the measurement. The measurement conditions are as follows.

oven: Standard Air Oven
measurement type: temperature scan
DMA condition: single frequency/strain (G)
frequency: 1 Hz
strain: 0.05 mm
start temperature: 25° C.
completion temperature: 180° C.
scan rate: 20° C./min or 5° C./min
deformation mode: single cantilever (B)
cross section: rectangle (R)
test specimen size (length): 17.5 mm
test specimen size (width): 7.5 mm
test specimen size (thickness): 1.5 mm The onset temperature T(A) ° C. is calculated from the curve of the storage elastic modulus E' yielded by measurement of 20° C./min of scan rate, and the onset temperature T(B) ° C. is calculated from the curve of the storage elastic modulus E' yielded by measurement of 5° C./min of scan rate. The "onset temperature" refers to a temperatures corresponding to the intersection between the straight line provided by extending the baseline on the low-temperature side of the E' curve to the high-temperature side, and the tangent drawn at the point at which the slope of the E' curve assumes a maximum.

Identification of the Crystalline Material Domains

Identification of the crystalline material domains is carried out in accordance with the following procedure based on the TEM image of the toner particle cross section.

When crystalline materials can be acquired in raw material form, the crystalline structures thereof are observed proceeding as in the above-described method for observing the ruthenium-stained toner particle cross section using a transmission electron microscope (TEM) and the lamellar structure of the crystals in each raw material is imaged. These are compared with the lamellar structure in the domains of the toner particle cross section, and the raw material forming the domains in the toner particle cross section can be identified when the error for the layer distance of the lamellae is not greater than 10%.

(Isolation of the Crystalline Material)

An isolation procedure is carried out as follows when the raw material for the crystalline material cannot be acquired.

First, the toner is dispersed in ethanol, which is a poor solvent for the toner, and heating is carried out to a temperature that exceeds the melting point of the crystalline material. Pressure may be applied at this point as necessary. The crystalline material above the melting point melts at this point.

A mixture containing the crystalline material can then be recovered from the toner by solid-liquid separation. The crystalline material can be isolated by fractionating this mixture into individual molecular weights.

EXAMPLES

Hereinafter, the present invention will be described in more detail with reference to Examples and Comparative Examples, but the present invention is not limited thereto. The number of parts in the Examples and Comparative Examples is based on mass unless otherwise specified.

Production Example of Amorphous Polyester Resin A1

| | |
|---|---|
| Terephthalic acid | 30.0 parts |
| Trimellitic acid | 5.0 parts |
| Bisphenol A propylene oxide (2 mol) adduct | 160.0 parts |
| Dibutyltin oxide | 0.1 parts |

The abovementioned materials were placed in a heated and dried two-necked flask, nitrogen gas was introduced into the vessel to maintain an inert atmosphere, and the temperature was raised while stirring. Thereafter, a condensation polymerization reaction was performed at from 150° C. to 230° C. for about 12 hours, and the pressure was thereafter gradually reduced at from 210° C. to 250° C. to obtain an amorphous polyester resin A1.

The number average molecular weight (Mn) of the amorphous polyester resin A1 was 10,100, the weight average molecular weight (Mw) was 24,500, and the glass transition temperature (Tg) was 77.0° C.

Production Example of Crystalline Polyester Resin B1

| | |
|---|---|
| Sebacic acid | 123.7 parts |
| 1,9-Nonanediol | 76.3 parts |
| Dibutyltin oxide | 0.1 part |

The abovementioned materials were placed in a heated and dried two-necked flask, nitrogen gas was introduced into the vessel to maintain an inert atmosphere, and the temperature was raised while stirring. Thereafter, stirring was performed at 180° C. for 6 hours. The temperature was then gradually raised to 230° C. under reduced pressure while continuing stirring, and further maintained for 2 hours. When the mixture became viscous, the mixture was air-cooled and the reaction was stopped to obtain a crystalline polyester resin B1.

The weight average molecular weight (Mw) of the crystalline polyester resin B1 was 39,500 and the melting point was 66.0° C.

Magnetic Iron Oxide 1 Production Example 55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were reslurried by redispersion in water. To this reslurry liquid, sodium silicate was added to provide 0.20 mass % as silicon per 100 parts of the core particles; the pH of the slurry was adjusted to 6.0; and magnetic iron oxide particles having a silicon-rich surface were obtained by stirring. The obtained slurry was filtered and washed with a filter press and was reslurried with deionized water.

Into this reslurry liquid (solids fraction=50 g/L) was introduced 500 g (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average particle diameter of 0.23 μm.

Silane Compound Production 30 parts of isobutyltrimethoxysilane was added dropwise while stirring into 70 parts of deionized water. This aqueous solution was then held at a pH of 5.5 and a temperature of 55° C. and a hydrolysis was run by dispersing for 120 minutes at a peripheral velocity of 0.46 μm/s using a disper impeller. The hydrolysis reaction was then stopped by bringing the pH of the aqueous solution to 7.0 and cooling to 10° C. This yielded a silane compound-containing aqueous solution.

Colorant C1 Production Example 100 parts of the aforementioned magnetic iron oxide 1 was introduced into a high-speed mixer (Model LFS-2 from Fukae Powtec Corporation) and 8.0 parts of the silane compound-containing aqueous solution was added dropwise over 2 minutes while stirring at a rotation rate of 2,000 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a colorant C1.

Crystalline Material

Crystalline materials D1 to D6 shown in Table 1 were prepared as crystalline materials.

TABLE 1

| | Crystalline material | Melting point (° C.) |
|---|---|---|
| D1 | Paraffin wax (HNP-9, manufactured by Nippon Seiro Co., Ltd.) | 75.0 |
| D2 | Ethylene glycol distearate | 76.0 |
| D3 | Ethylene glycol dibehenate | 83.0 |
| D4 | Dibehenyl sebacate | 74.0 |
| D5 | Crystalline polyester resin B1 | 66.0 |
| D6 | Paraffin wax (C105, manufactured by Shumann Sasol (SA) (Pty) Ltd.) | 105.0 |

Production Example of Toner Particles 1

Preparation of Aqueous Medium

A total of 450 parts of a 0.1 mol/L-$Na_3PO_4$ aqueous solution was added to 720 parts of ion exchanged water followed by heating to a temperature of 60° C., and then 67.7 parts of a 1.0 mol/L-$CaCl_2$ aqueous solution was added to obtain an aqueous medium including a dispersion stabilizer.

Preparation of Polymerizable Monomer Composition

| | |
|---|---|
| Styrene (St in the Tables) | 72.0 parts |
| n-Butyl acrylate (BA in the Tables) | 28.0 parts |
| 1,6-hexanediol diacrylate (HDDA in the Tables) | 0.90 parts |
| Amorphous polyester resin A1 | 5.0 parts |
| Negative charge control agent T-77 (manufactured by Hodogaya Chemical Co., Ltd.) | 1.0 part |
| Colorant C1 | 70.0 parts |

The above materials were uniformly dispersed and mixed using an attritor (Nippon Coke Industry Co., Ltd.).

The obtained monomer composition was heated to a temperature of 60° C., and the following materials were mixed and dissolved therein to obtain a polymerizable monomer composition.

| | |
|---|---|
| Crystalline material D1 | 5.0 parts |
| Crystalline material D2 | 20.0 parts |
| Polymerization initiator (t-butyl peroxypivalate (25% toluene solution)) | 8.0 parts |

The polymerizable monomer composition was loaded into the aqueous medium and granulated by stirring at a rotation speed of 10,000 rpm for 15 min with T. K. HOMOMIXER (Tokushu Kika Kogyo Co., Ltd.) in a $N_2$ atmosphere at a temperature of 60° C.

Thereafter, the mixture was stirred with a paddle stirring blade, and a polymerization reaction was performed at a reaction temperature of 70° C. for 300 min.

After the completion of the reaction, the temperature was raised to 98° C. and distillation was performed for 3 h to obtain a reaction slurry. Thereafter, as a cooling step, water at 0° C. was poured into the suspension, and the suspension was cooled from 98.0° C. to 30° C. at a rate of 100° C./min, then heated to 50° C. and allowed to stand for 6 h. The suspension was then naturally cooled to 25° C. at room temperature. The cooling rate at that time was 1° C./min. Thereafter, hydrochloric acid was added to the suspension for sufficient washing thereby dissolving the dispersion stabilizer, followed by filtration and drying to obtain toner particles 1. Table 2 shows the formulation of the obtained toner particles 1.

Production Example of Toner 1

A total of 0.3 parts of sol-gel silica fine particles having a number-average particle diameter of primary particles of 115 nm was added to 100 parts of toner particles 1, and mixing was performed using a FM mixer (manufactured by Nippon Coke Industries, Ltd.). Thereafter, 0.9 parts of hydrophobic silica fine particles obtained by treating silica fine particles having a number-average particle diameter of primary particles of 12 nm with hexamethyldisilazane and then treated with silicone oil and having a BET specific surface area value of 120 $m^2/g$ after the treatment was further added, followed by likewise mixing with the FM mixer (manufactured by Nippon Coke Industries, Ltd.) to obtain a toner 1. The properties of the obtained toner 1 are shown in Table 3 below.

Example 1

LaserJet Pro M12 (manufactured by Hewlett-Packard Company) of a one-component contact developing system was used as an image forming apparatus after being modified to 300 mm/sec, which is faster than the original process speed, and so that the fixing temperature could be changed.

Table 4 shows the evaluation results. The evaluation method and evaluation criteria in each evaluation are as follows.

Evaluation 1: Evaluation of Gloss Unevenness Evaluation of gloss unevenness was performed in a normal-temperature and normal-humidity environment (temperature: 25.0° C., relative humidity: 60%), and OCE RED LABEL (basis weight: 80 $g/m^2$) was used as paper.

The gloss was measured using a hand-held gloss meter PG-1 (manufactured by Nippon Denshoku Industries Co., Ltd.). In the measurement, the light projection angle and the light reception angle were each set to 75°. As for the image gloss value, the gloss value (gloss) of ten points randomly selected from the output image was measured, and the gloss unevenness was evaluated by the difference between the highest gloss and the lowest gloss. The evaluation criteria were as follows.

A: the gloss difference is less than 2.00%.

B: the gloss difference is 2.00% or more and less than 5.00%.

C: the gloss difference is 5.00% or more and less than 10.00%.

D: the gloss difference is 10.00% or more.

Evaluation 2: Evaluation of Hot Offset Resistance on Edges

Evaluation of hot offset resistance on the edges was performed in a normal-temperature and normal-humidity environment (temperature: 25.0° C., relative humidity: 60%), and paper having a basis weight of 66 $g/m^2$ was used. After 500 horizontal line patterns with a print percentage of 2% were printed on A5 size paper, 100 horizontal line patterns with a print percentage of 2% were continuously printed on A4 size paper. The number of prints in which edge offset has occurred on the edges of A4 size paper was visually observed and evaluated according to the following criteria. The disappearance of the edge offset on a small number of prints indicates superior resistance to edge offset.

A: no occurrence of edge offset.

B: edge offset disappears by the fifth sheet.

C: edge offset disappears by the tenth sheet.

D: edge offset does not disappear even after tenth sheet.

Evaluation 3: Evaluation of Low-Temperature Fixability

The low-temperature fixability was evaluated in a normal-temperature and normal-humidity environment (temperature: 25.0° C., relative humidity: 60%).

The modification was made to enable arbitrary setting of the fixing temperature of the fixing unit in the image forming apparatus. Using this apparatus, the fixing temperature of the fixing unit was regulated at an interval of 5° C. within a range from 180° C. to 230° C., FOX RIVER BOND paper (110 $g/m^2$) as a rough paper was used, and a solid black image was outputted at a print percentage of 100%. At this time, it was visually evaluated whether a blank dot was present in the image of the solid image portion, and the low-temperature fixability was evaluated by the lowest temperature at which the blank dot was generated.

A: blank dot occurs at lower than 200° C.

B: blank dot occurs at 200° C. or higher and lower than 210° C.

C: blank dot occurs at 210° C. or higher and lower than 220° C.

D: blank dot occurs at 220° C. or higher.

Evaluation 4: Evaluation of Storage Stability

In a storage stability test, a solid image was obtained in a normal-temperature and normal-humidity environment (temperature: 25.0° C., relative humidity: 60%), and then stored for 40 days together with the developing device under a severe environment (temperature: 40.0° C., relative humidity: 95%). After the storage, a solid image was outputted in a normal-temperature and normal-humidity environment (temperature: 25.0° C., relative humidity: 60%), and comparative evaluation of image density before and after the storage was performed. The density of the solid image was measured with a Macbeth reflection densitometer (manufactured by Macbeth).

A: the density difference is less than 0.05.

B: the density difference is 0.05 or more and less than 0.10.

C: the density difference is 0.10 or more and less than 0.20.

D: the density difference is 0.20 or more.

Production Examples of Toner Particles 2 to 17, 19 to 21, and 23 to 27

Toner particles 2 to 17, 19 to 21, and 23 to 27 were obtained in the same manner as in Production Example of Toner Particle 1, except that the conditions were changed as shown in Table 2.

TABLE 2

| Toner | Monomer | | Crosslinking agent | | Colorant C | | Crystalline material D | | | | | | Post-distillaton cooling step | |
|---|---|---|---|---|---|---|---|---|---|---|---|---|---|---|
| | | | | Divinyl- | | | | | | | | | Cooling start | Coding rate |
| Particle No. | St (Parts) | BA (Parts) | HDDA (Parts) | benzene (Parts) | C1 (Parts) | C2 (Parts) | D1 (Parts) | D2 (Parts) | D3 (Parts) | D4 (Parts) | D5 (Parts) | D6 (Parts) | temperature (T1)° C. | (Ts1)° C./min |
| 1 | 72.0 | 28.0 | 0.90 | — | 70.0 | — | 5.0 | 20.0 | — | — | — | — | 98.0 | 100 |
| 2 | 72.0 | 28.0 | 0.70 | — | 70.0 | — | 5.0 | 20.0 | — | — | — | — | 98.0 | 100 |
| 3 | 78.0 | 22.0 | 0.90 | — | 70.0 | — | 5.0 | 15.0 | — | — | — | — | 80.0 | 20 |

TABLE 2-continued

| Toner Particle No. | Monomer St (Parts) | Monomer BA (Parts) | Crosslinking agent HDDA (Parts) | Crosslinking agent Divinylbenzene (Parts) | Colorant C C1 (Parts) | Colorant C C2 (Parts) | Crystalline material D D1 (Parts) | Crystalline material D D2 (Parts) | Crystalline material D D3 (Parts) | Crystalline material D D4 (Parts) | Crystalline material D D5 (Parts) | Crystalline material D D6 (Parts) | Post-distillaton cooling step Cooling start temperature (T1)° C. | Post-distillaton cooling step Coding rate (Ts1)° C./min |
|---|---|---|---|---|---|---|---|---|---|---|---|---|---|---|
| 4 | 72.0 | 28.0 | 0.70 | — | 70.0 | — | 5.0 | 20.0 | — | — | — | — | 98.0 | 100 |
| 5 | 72.0 | 28.0 | 1.20 | — | 70.0 | — | 5.0 | 20.0 | — | — | — | — | 98.0 | 100 |
| 6 | 78.0 | 22.0 | 0.70 | — | 70.0 | — | 5.0 | 20.0 | — | — | — | — | 98.0 | 100 |
| 7 | 69.0 | 31.0 | 1.20 | — | 70.0 | — | 5.0 | 20.0 | — | — | — | — | 98.0 | 100 |
| 8 | 72.0 | 28.0 | 0.90 | — | 70.0 | — | 10.0 | 15.0 | — | — | — | — | 98.0 | 100 |
| 9 | 72.0 | 28.0 | 0.90 | — | 70.0 | — | 5.0 | 15.0 | — | — | — | — | 98.0 | 20 |
| 10 | 72.0 | 28.0 | 0.90 | — | 70.0 | — | 5.0 | 15.0 | — | — | — | — | 98.0 | 10 |
| 11 | 72.0 | 28.0 | 0.90 | — | 70.0 | — | 5.0 | 15.0 | — | — | — | — | 80.0 | 10 |
| 12 | 72.0 | 28.0 | 0.90 | — | 70.0 | — | 10.0 | 20.0 | — | — | — | — | 98.0 | 100 |
| 13 | 72.0 | 28.0 | 0.90 | — | 70.0 | — | 15.0 | 20.0 | — | — | — | — | 98.0 | 100 |
| 14 | 72.0 | 28.0 | 0.90 | — | 65.0 | — | 5.0 | 20.0 | — | — | — | — | 98.0 | 100 |
| 15 | 72.0 | 28.0 | 0.90 | — | 60.0 | — | 5.0 | 20.0 | — | — | — | — | 98.0 | 100 |
| 16 | 72.0 | 28.0 | 0.90 | — | 85.0 | — | 5.0 | 20.0 | — | — | — | — | 98.0 | 100 |
| 17 | 72.0 | 28.0 | 0.90 | — | 95.0 | — | 5.0 | 20.0 | — | — | — | — | 98.0 | 100 |
| 18 | 72.0 | 28.0 | 0.90 | — | — | 10.0 | 5.0 | 20.0 | — | — | — | — | 98.0 | 100 |
| 19 | 72.0 | 28.0 | 0.90 | — | 70.0 | — | 5.0 | — | 20.0 | — | — | — | 98.0 | 100 |
| 20 | 72.0 | 28.0 | 0.90 | — | 70.0 | — | 5.0 | — | — | 20.0 | — | — | 98.0 | 100 |
| 21 | 72.0 | 28.0 | 0.50 | — | 70.0 | — | 5.0 | 20.0 | — | — | 20.0 | — | 98.0 | 100 |
| 22 | 72.0 | 28.0 | 0.50 | — | — | 10.0 | 5.0 | 20.0 | — | — | — | — | 98.0 | 100 |
| 23 | 72.0 | 28.0 | 2.50 | — | 70.0 | — | 5.0 | 20.0 | — | — | — | — | 98.0 | 100 |
| 24 | 72.0 | 28.0 | 0.90 | — | 70.0 | — | 5.0 | 8.0 | — | — | — | 10.0 | 98.0 | 100 |
| 25 | 78.0 | 22.0 | 0.65 | — | 90.0 | — | 10.0 | — | — | 10.0 | 7.0 | — | 100.0 | 150 |
| 26 | 74.0 | 26.0 | — | 0.20 | 90.0 | — | — | 10.0 | — | — | 10.0 | — | 100.0 | 135 |
| 27 | 72.0 | 28.0 | 2.50 | — | 60.0 | — | 5.0 | 25.0 | — | — | — | — | 98.0 | 100 |

TABLE 3

| | Toner No | Toner D4 (μm) | DMA rate dependence T(A)-T(B) (° C.) | THF insoluble component (% by mass) | Major as of domain of crystalline material: Average length (nm) | Major as of domain of crystalline material: Average number of domains of 20 nm to 300 nm | Number ratio of toner with major axis of 500 nm or more C/(C + D) | Peak temperature (° C.) | Area ratio A1 (%) | SP value difference between crystalline material and binder resin \|SP(W)-SP(B)\| |
|---|---|---|---|---|---|---|---|---|---|---|
| Example | 1 | 747 | 0.2 | 41 | 52 | 350 | 0.00 | 69.2 | 58.0 | 3.66 |
| | 2 | 754 | 0.5 | 32 | 52 | 312 | 0.00 | 69.1 | 59.0 | 3.66 |
| | 3 | 778 | 2.8 | 51 | 280 | 5 | 0.10 | 69.1 | 57.0 | 3.66 |
| | 4 | 779 | 0.7 | 16 | 56 | 339 | 0.06 | 69.1 | 59.0 | 3.66 |
| | 5 | 729 | 2.7 | 58 | 61 | 307 | 0.02 | 69.2 | 60.0 | 3.66 |
| | 6 | 735 | 2.9 | 18 | 54 | 286 | 0.04 | 69.0 | 59.0 | 3.66 |
| | 7 | 772 | 0.5 | 58 | 50 | 322 | 0.06 | 68.9 | 56.0 | 3.66 |
| | 8 | 764 | 2.8 | 49 | 45 | 151 | 0.56 | 75.5 | 56.0 | 3.66 |
| | 9 | 740 | 0.4 | 43 | 150 | 56 | 0.04 | 69.0 | 58.0 | 3.66 |
| | 10 | 781 | 0.5 | 49 | 270 | 12 | 0.10 | 69.1 | 59.0 | 3.66 |
| | 11 | 713 | 0.3 | 53 | 350 | 6 | 0.12 | 69.2 | 57.0 | 3.66 |
| | 12 | 745 | 0.9 | 40 | 60 | 105 | 0.18 | 69.0 | 56.0 | 3.66 |
| | 13 | 741 | 1.8 | 48 | 40 | 147 | 0.60 | 69.1 | 50.0 | 3.66 |
| | 14 | 763 | 0.4 | 47 | 53 | 344 | 0.02 | 69.2 | 35.0 | 3.66 |
| | 15 | 768 | 0.3 | 46 | 49 | 351 | 0.00 | 69.0 | 30.0 | 3.66 |
| | 16 | 739 | 1.2 | 48 | 53 | 339 | 0.00 | 69.2 | 75.0 | 3.66 |
| | 17 | 744 | 2.6 | 45 | 56 | 352 | 0.00 | 69.0 | 81.0 | 3.66 |
| | 18 | 750 | 0.4 | 48 | 50 | 331 | 0.02 | 69.1 | 0.0 | 3.66 |
| | 19 | 761 | 1.0 | 45 | 56 | 346 | 0.04 | 69.0 | 46.0 | 3.88 |
| Comparative Example | 20 | 792 | 3.8 | 40 | 60 | 150 | 0.98 | 59.0 | 47.0 | 4.02 |
| | 21 | 749 | 2.3 | 8 | 94 | 91 | 0.04 | 65.8 | 47.0 | 3.66 |
| | 22 | 759 | 0.5 | 10 | 50 | 322 | 0.02 | 69.8 | 0.0 | 3.66 |
| | 23 | 764 | 3.1 | 72 | 50 | 308 | 0.00 | 69.1 | 46.0 | 3.66 |
| | 24 | 777 | 3.2 | 45 | 50 | 132 | 0.98 | 98.5 | 58.0 | 3.66 |
| | 25 | 769 | 3.7 | 42 | 60 | 161 | 0.96 | 59.0 | 69.0 | 4.02 |
| | 26 | 768 | 3.9 | 14 | 62 | 215 | 0.00 | 65.7 | 68.0 | 3.66 |
| | 27 | 732 | 2.2 | 77 | 51 | 390 | 0.00 | 69.0 | 55.0 | 3.66 |

TABLE 4

| | Example/ Comparative Example No. | Toner No. | <Gloss unevenness> (gloss difference (%)) | <Resistance to hot offset on edges> | <Low-temperature fixability> (white dot temperature (° C.)) | <Storage Stability> (density difference) |
|---|---|---|---|---|---|---|
| Example | Example 1 | Toner 1 | A (1.58) | A | A (190) | A (0.01) |
| | Example 2 | Toner 2 | A (1.69) | B | A (190) | A (0.03) |
| | Example 3 | Toner 3 | C (7.54) | A | C (215) | A (0.01) |
| | Example 4 | Toner 4 | B (4.53) | C | A (190) | A (0.03) |
| | Example 5 | Toner 5 | C (6.57) | A | C (215) | A (0.01) |
| | Example 6 | Toner 6 | C (9.38) | C | B (200) | A (0.04) |
| | Example 7 | Toner 7 | A (1.61) | A | B (200) | A (0.02) |
| | Example 8 | Toner 8 | C (7.94) | A | C (215) | A (0.01) |
| | Example 9 | Toner 9 | A (1.87) | A | B (200) | A (0.02) |
| | Example 10 | Toner 10 | B (2.72) | A | B (200) | A (0.02) |
| | Example 11 | Toner 11 | B (3.99) | A | C (210) | A (0.01) |
| | Example 12 | Toner 12 | B (3.25) | A | B (200) | A (0.02) |
| | Example 13 | Toner 13 | C (6.02) | A | C (210) | A (0.01) |
| | Example 14 | Toner 14 | A (1.87) | A | A (190) | B (0.07) |
| | Example 15 | Toner 15 | A (1.72) | A | A (190) | C (0.12) |
| | Example 16 | Toner 16 | B (4.01) | A | B (200) | A (0.02) |
| | Example 17 | Toner 17 | C (7.18) | A | C (215) | A (0.02) |
| | Example 18 | Toner 18 | A (1.89) | A | A (190) | C (0.18) |
| | Example 19 | Toner 19 | A (1.62) | A | A (190) | A (0.02) |
| Comparative Example | Comparative Example 1 | Toner 20 | D (11.23) | A | C (215) | A (0.02) |
| | Comparative Example 2 | Toner 21 | C (9.68) | D | A (195) | A (0.03) |
| | Comparative Example 3 | Toner 22 | C (8.87) | D | A (195) | C (0.19) |
| | Comparative Example 4 | Toner 23 | D (13.90) | A | D (220) | A (0.02) |
| | Comparative Example 5 | Toner 24 | D (13.80) | A | D (220) | A (0.02) |
| | Comparative Example 6 | Toner 25 | D (11.92) | A | C (215) | A (0.02) |
| | Comparative Example 7 | Toner 26 | D (14.95) | D | A (195) | A (0.03) |
| | Comparative Example 8 | Toner 27 | C (7.22) | A | D (220) | A (0.02) |

Production Example of Toner Particle 18

Preparation of Aqueous Medium

After 585 parts of a 0.1 mol/L-$Na_3PO_4$ aqueous solution was added to 720 parts of ion-exchanged water and the temperature was raised to 60° C., 88.0 parts of a 1.0 mol/L-$CaCl_2$ aqueous solution was added to obtain an aqueous medium including a dispersion stabilizer.

Preparation of Amorphous Polyester Resin Solution

| | |
|---|---|
| Styrene (St in the table) | 32.0 parts |
| N-butyl acrylate (BA in the table) | 28.0 parts |
| 1,6-Hexanediol diacrylate (HDDA in the table) | 0.90 parts |
| Amorphous polyester resin A1 | 5.0 parts |

The above materials were uniformly dispersed and mixed using an attritor (Nippon Coke Industry Co., Ltd.) to prepare an amorphous polyester resin solution.

Preparation of Pigment-dispersed Solution

| | |
|---|---|
| Styrene | 40.0 parts |
| Colorant C2 (copper phthalocyanine pigment (Pigment Blue 15:3)) | 10.0 parts |
| Negative charge control agent T-77 (manufactured by Hodogaya Chemical Industry) | 1.0 part |

The abovementioned materials were mixed, and the mixture was stirred with zirconia beads (3/16 inch) at 200 rpm for 4 hours using an attritor (Nippon Coke Industry Co., Ltd.), and the beads were separated to prepare a pigment-dispersed solution.

Preparation of Polymerizable Monomer Composition

The monomer composition obtained by mixing the amorphous polyester resin solution and the pigment-dispersed solution was heated to a temperature of 60° C., and the following materials were mixed and dissolved therein to form a polymerizable monomer composition.

| | |
|---|---|
| Crystalline material D1 | 5.0 parts |
| Crystalline material D2 | 20.0 parts |
| Polymerization initiator (t-butyl peroxypivalate (25% toluene solution)) | 8.0 parts |

The polymerizable monomer composition was loaded into the aqueous medium and stirred at a temperature of 60° C. and under a nitrogen atmosphere, for 15 minutes at a rotation speed of 10,000 rpm with a T. K. Homomixer (Tokushu Kika Kogyo Co., Ltd.), and granulated.

Thereafter, stirring was performed with a paddle stirring blade, and a polymerization reaction was conducted at a reaction temperature of 70° C. for 300 minutes.

After completion of the reaction, the temperature was raised to 98° C. and distillation was performed for 3 hours to obtain a reaction slurry. Thereafter, as a cooling step, water at 0° C. was poured into the suspension, the suspension was cooled from 98.0° C. to 30° C. at a rate of 100° C./min, and then heated to 50° C. and held for 6 hours. Then, the suspension was cooled naturally at room temperature to 25° C. The cooling rate at that time was 1° C./min. Thereafter, hydrochloric acid was added to the suspension and sufficient washing was performed to dissolve the dispersion stabilizer, followed by filtration and drying to obtain Toner Particles 18. Table 2 shows the formulation of the obtained Toner Particles 18.

Production Example of Toner Particle 22

Toner Particles 22 were obtained in the same manner as in Production Example of Toner Particles 18 except that the conditions were changed as shown in Table 2.

Production Examples of Toners 2 to 27

Toners 2 to 27 were obtained in the same manner as in Production Example of Toner 1 except that the Toner Particles 1 were replaced with Toner particles 2 to 27, respectively. Table 3 shows the physical properties of Toners 2 to 27 obtained.

Furthermore, Toners 2 to 27 were evaluated in the same manner as in Example 1. Table 4 shows the results.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120148, filed Jun. 27, 2019 which is hereby incorporated by reference herein in its entirety.

What is claimed is:

1. A toner, comprising:

a toner particle comprising a binder resin, a crystalline material and a magnetic body;

an amount of a tetrahydrofuran-insoluble component in the binder resin is 15 to 60% by mass;

a peak temperature of a maximum endothermic peak of the toner in differential scanning calorimetry is 50.0 to 90.0° C.; and Al is 35.0 to 80.0% in a cross section of the toner observed with a transmission electron microscope, where Al is an area ratio of the magnetic body in a range from a contour of the cross section to 400 nm in a direction of a center of gravity of the cross section, wherein T(A)−T(B) 3.0° C. where T(A)° C. and T(B)° C. are respectively onset temperatures of a storage elastic modulus E' obtained when a temperature is raised at 20° C/min and by 5° C/min.

2. The toner according to claim 1, wherein an average number of domains of the crystalline material having a major axis from 20 nm to 300 nm is from 50 to 500 in a cross section of the toner observed with a transmission electron microscope.

3. The toner according to claim 1, wherein

C/(C+D)≤0.20 when C and D are respectively numbers of toner particles having domains of the crystalline material that have a major axis of 500 nm or more, and of toner particles that do not have domains of the crystalline material having a major axis of 500 nm or more in a cross section of the toner observed with a transmission electron microscope.

4. The toner according to claim 1, wherein the domains of the crystalline material have an average major axis length of 50 to 300 nm in the cross section of the toner observed with a transmission electron microscope.

5. The toner according to claim 1, wherein the crystalline material includes an ester wax.

6. The toner according to claim 5, wherein the ester wax has a molecular weight of 800 or less.

7. The toner according to claim 5, wherein $2.00 \leq |SP(W)-SP(B)| \leq 4.50$ where SP (W) $(J/cm^3)^{1/2/}$ is an SP value of the ester wax and SP (B)$(J/cm^3)^{1/2}$ is an SP value of the binder resin.

8. The toner according to claim 1, wherein an amount of the magnetic body is 25 to 100 parts by mass with respect to 100 parts by mass of the binder resin.

9. The toner according to claim 1, wherein an amount of the magnetic body is 25 to 90 parts by mass with respect to 100 parts by mass of the binder resin.

* * * * *